US006543378B1

(12) United States Patent
Johnson, Sr.

(10) Patent No.: US 6,543,378 B1
(45) Date of Patent: Apr. 8, 2003

(54) PERSONAL WATERCRAFT

(76) Inventor: Toney R. Johnson, Sr., 4872 N. Effie, Fresno, CA (US) 93726

( * ) Notice: Subject to any disclaimer, the term of this patent is extended or adjusted under 35 U.S.C. 154(b) by 0 days.

(21) Appl. No.: 09/963,071

(22) Filed: Sep. 24, 2001

(51) Int. Cl.[7] ..... B63B 3/00

(52) U.S. Cl. ..... 114/346; 114/345; 114/363; 441/67

(58) Field of Search ..... 114/345, 343, 114/346, 354, 363, 55.5; 441/65, 66, 67

(56) References Cited

U.S. PATENT DOCUMENTS

| | | | | | |
|---|---|---|---|---|---|
| 1,793,905 | A | | 2/1931 | Chestnut | |
| 2,674,753 | A | | 4/1954 | Wood | |
| 2,683,270 | A | * | 7/1954 | Long | 114/345 |
| 3,324,488 | A | * | 6/1967 | Schulz, Jr. | 114/346 |
| 3,665,534 | A | | 5/1972 | McIntyre | |
| 3,694,835 | A | * | 10/1972 | Casey et al. | 114/345 |
| 3,718,111 | A | * | 2/1973 | Del Vecchio | 114/346 |
| 3,871,042 | A | * | 3/1975 | Farmer | 114/346 |
| 4,021,873 | A | | 5/1977 | Francois | |
| 4,367,689 | A | * | 1/1983 | Lukehart et al. | 114/346 |
| 4,635,581 | A | * | 1/1987 | Scheurer | 114/345 |
| 4,771,722 | A | | 9/1988 | Tihany | |
| 5,101,753 | A | * | 4/1992 | Hull et al. | 114/345 |
| 5,279,510 | A | * | 1/1994 | Remy | 114/345 |
| 5,331,914 | A | * | 7/1994 | Salmons | 114/346 |
| 5,485,981 | A | * | 1/1996 | Lindahl | 114/345 |
| 5,643,031 | A | * | 7/1997 | Fenton et al. | 114/345 |
| D384,636 | S | | 10/1997 | Beck et al. | |
| 5,779,509 | A | * | 7/1998 | Barman | 114/345 |
| 6,220,908 | B1 | * | 4/2001 | Peterson | 114/345 |

* cited by examiner

*Primary Examiner*—S. Joseph Morano
*Assistant Examiner*—Lars A. Olson
(74) *Attorney, Agent, or Firm*—Gene Scott-Patent Law & Venture Group

(57) ABSTRACT

A watercraft apparatus comprises a rigid platform supporting a seat on an upper surface and a rudder rearward and extending downwardly for providing stability to the apparatus when afloat. A strut extends forward of the platform and supports a propulsion unit mount. A frame is engaged with the strut and extends downwardly for supporting an electrical battery. A toroidal flotation structure is engaged with the strut and the undersurface of the platform for floating the apparatus on a body of water the frame is received within a central aperture of the flotation structure and a bottom cover, integral with the flotation means, closes the center aperture at a lower surface of the flotation structure.

2 Claims, 3 Drawing Sheets

PERSONAL WATERCRAFT

BACKGROUND OF THE INVENTION

1. Field of the Invention

This invention relates generally to flotation devices and powered watercraft and more particularly to a personal watercraft for leisure activities such as fishing 2. Description of Related Art The following art defines the present state of this field Beck et al., U.S. Pat. No. Des. 384,636 describes a float power mount design.

Chestnut, U.S. Pat. No. 1,793,905 describes an aquatic amusement device, comprising a rigid open frame including side strips and cross braces at the front and rear, a seat suspended from and within the frame, and means for securing the frame in spanning relation to an annular float.

Wood, U.S. Pat. No. 2,674,753 describes a boat comprising spaced apart fore and aft sections, a pair of bottom stringers joined to and extending between said sections and a pair of top stringers joined to and extending between said sections, said stringers holding said sections in fixed relations to each other, and a removable inflated occupant supporting member of toroidal shape having an occupant supporting web attached, thereto, said occupant supporting member being located in the space between said sections and resting upon and being supported by said bottom stringers and engaged by said top stringers whereby said occupant supporting member is held in place.

McIntyre, U.S. Pat. No. 3,665,534 describes a fishing float motor support, a framework reinforced polygonal-shaped generally horizontal buoyant body with an arcuate recess nesting a peripheral portion of a conventional fishing float. Means on the body secures it to and maintains it in the plane of the fishing float. An upstanding transom, connected with body reinforcing framework, supports and outboard motor. Upwardly open sockets, formed in the body, support fishing equipment and a battery to provide electrical energy for the motor.

Francois, U.S. Pat. No. 4,021,873 describes a circular watercraft having a buoyant, generally toroidal hull supporting a rigid deck with an outer periphery in substantial conformance with the perimeter of the hull. The deck has an opening located above the central opening of the hull to permit placement of power means to drive and steer the watercraft. The hull can be an inflated structure such as an inner tube. A stabilizer assembly connected to the hull and deck lends horizontal and vertical stability to the craft. Reserve floatation can be provided by an auxiliary torodial pontoon nested within the central opening of the hull but normally located above the water line.

Tihany, U.S. Pat. No. 4,771,722 describes a floatable water craft which includes a first relatively large doughnut-shaped inner tube and a pair of second and third doughnut-shaped inner tubes. The inner tubes are preferably inflated with air although they may be filled with a foam material for adding additional buoyancy thereto. A frame is carried by the large inner tube and the frame includes an elongated longitudinal support member resting on diametrically opposite sides of the inner tube and a lateral cross support having opposite end portions resting on opposite sides of the first inner tube adjacent the longitudinal axis defined by the longitudinal support member. The ends of the lateral cross member hold the outrigger arms and include apparatus for mounting the second and third inner tube thereto for stabilizing the craft as per conventional outrigger devices. The apparatus may include an electric motor driven power drive unit and a steering device therefore. It may also include a radio/cassette player with remote speakers mounted on the second and third inner tubes; one or more devices for positionably housing beverage containers; and a bracket for mounting a cooler containing beverages and the like.

The prior art teaches the use of floatation devices used as the basis for personal water craft but does not teach a watercraft based on a large torus shaped float where the center hole is advantageously used for storage. The present invention fulfills these needs and provides further related advantages as described in the following summary.

SUMMARY OF THE INVENTION

The present invention teaches certain benefits in construction and use which give rise to the objectives described below.

A watercraft apparatus comprises a rigid platform supporting a seat on an upper surface and a rudder rearward and extends downwardly for providing stability to the apparatus when afloat. A strut extends forward of the platform and supports a propulsion unit mount. A frame is engaged with the strut and extends downwardly for supporting an electrical battery. A toroidal flotation structure is engaged with the undersurface of the platform and the strut for floating the apparatus on a body of water. The frame is received within a central aperture of the flotation structure and a bottom cover, integral with the flotation means, and is functional for closing the central aperture at a lower surface so that the central aperture may be used for storage.

A primary objective of the present invention is to provide apparatus advantages not taught by the prior art.

Another objective is to provide such an invention capable of carrying an electrical battery on board a simple float type watercraft using its weight for stability.

A further objective is to provide such an invention capable of storing items within a central cavity in an inflatable device.

A still further objective is to provide such an invention capable of providing access to the battery through a hinged panel.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
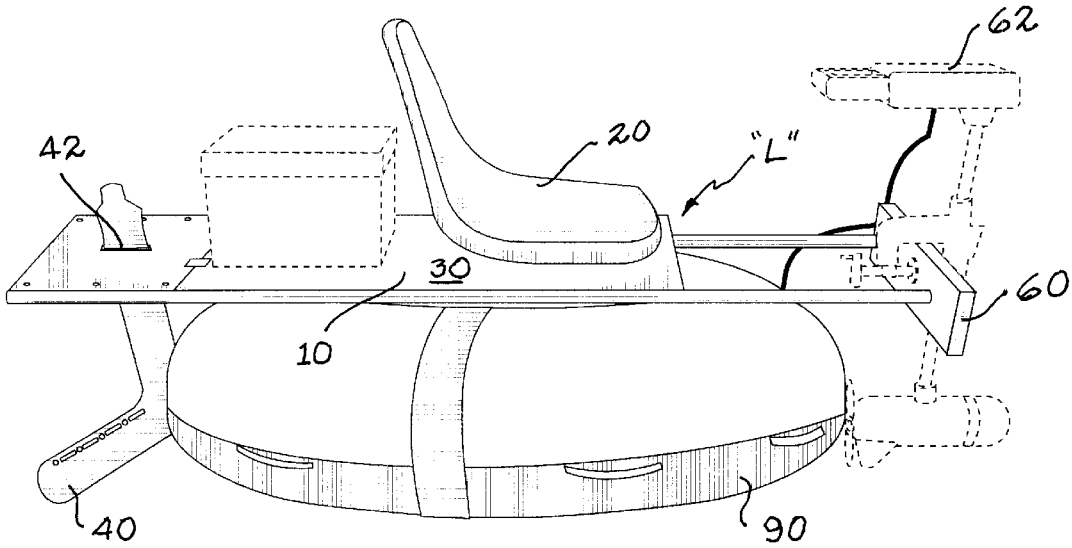
FIGS. 1 and 2 are side elevational views of the preferred embodiment of the invention.
Figure 2:
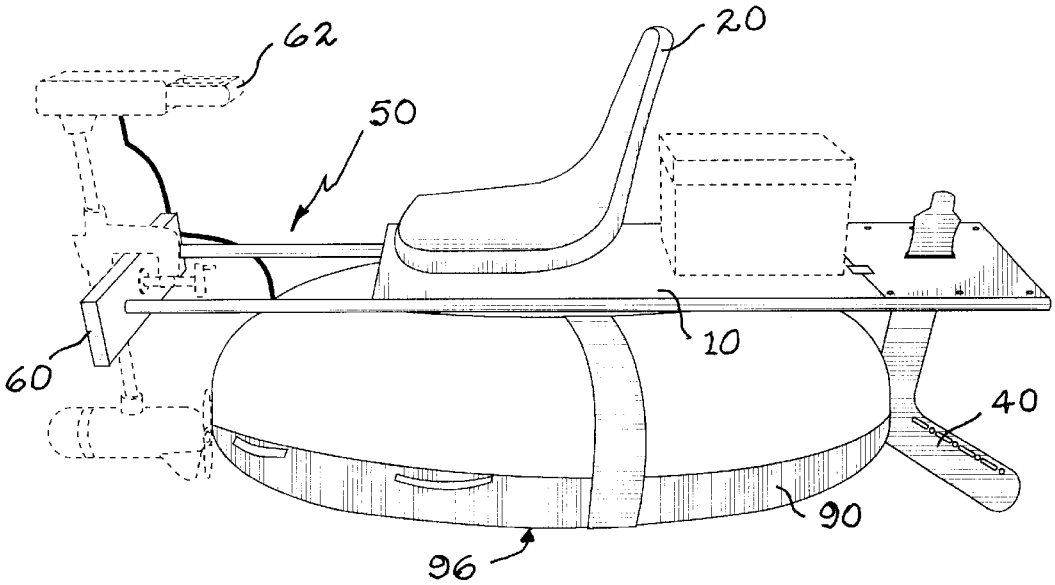
Figure 3:
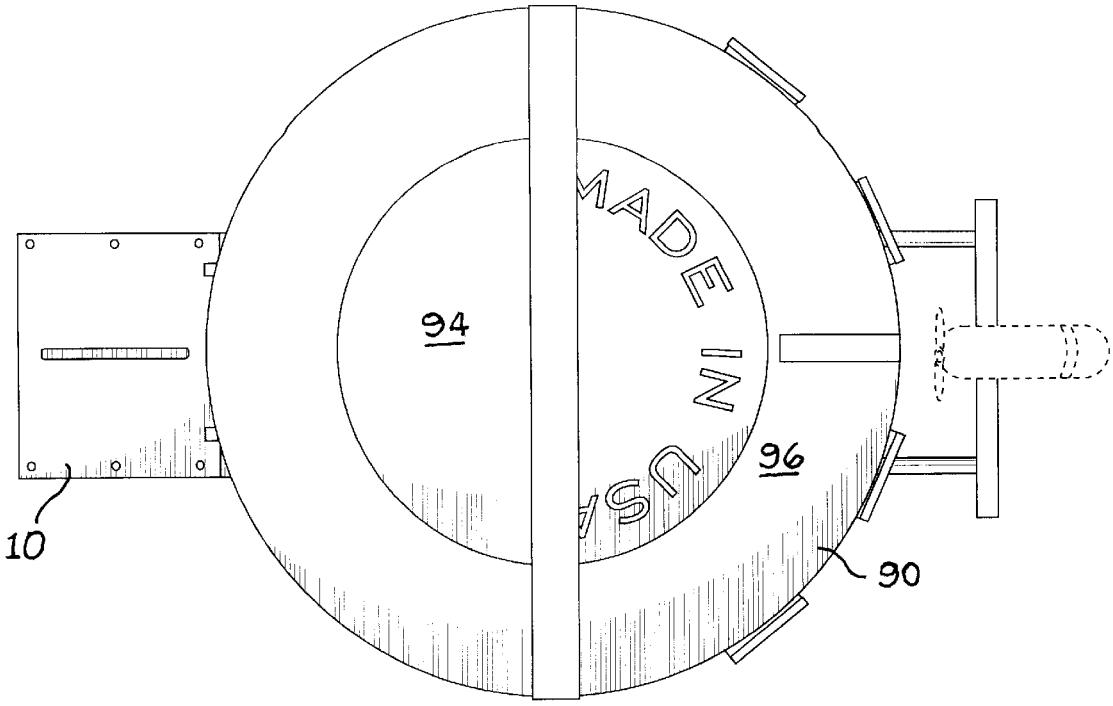
FIGS. 3 and 4 are bottom and top views respectively thereof.
Figure 4:
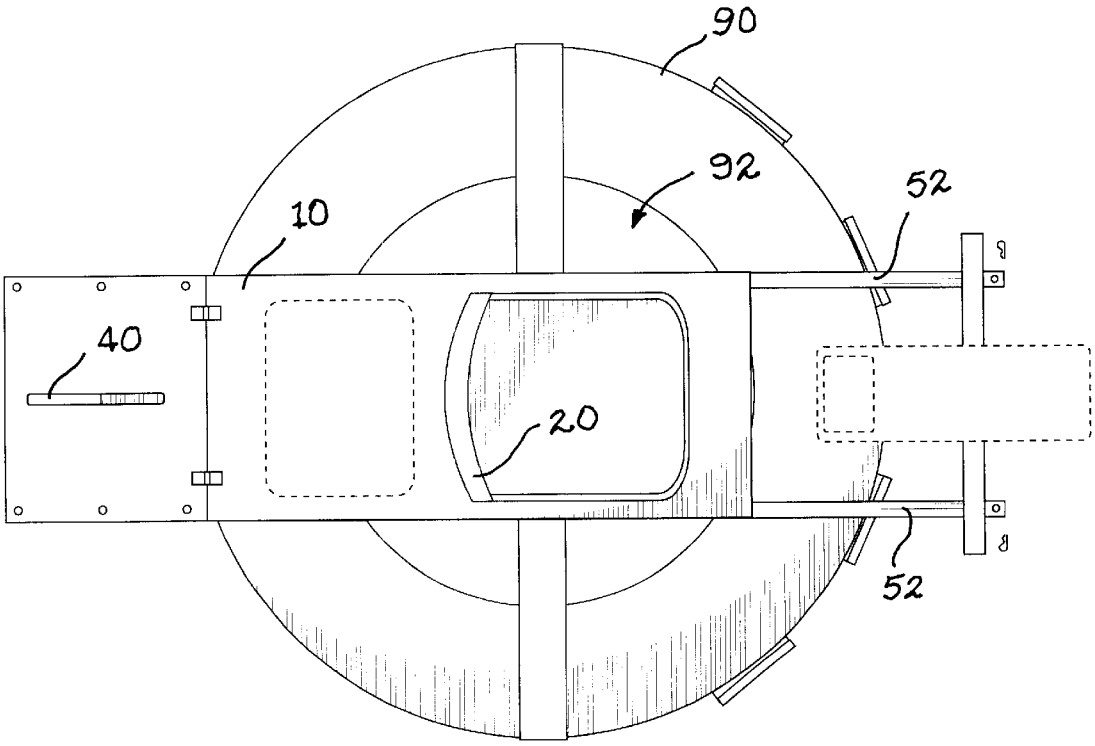

The above described drawing figures illustrate the invention in at least one of its preferred embodiments, which is further defined in detail in the following description.

A watercraft apparatus comprises a rigid platform 10 of wood or metal sheet, supporting a seat 20, such as an automotive type bucket seat, on its upper surface 30. A rudder 40, also made of wood or metal, is engaged in a manner, such as slot 42, for being moved toward or away from a vertical attitude so as to accommodate shallow water floatation of the apparatus, wherein the rudder 40 is able to rotate to a less vertical angle to draw less depth. The rudder 40 is positioned at a rearward end of the platform 10 and extends downwardly for providing stability to the apparatus. A strut 50 extends forward of the platform 10 and supports a propulsion unit mounting means 60. A propulsion unit 62 is preferably mounted onto the mounting means 60 to provide drive force for moving and steering the craft. A frame 70 (FIG. 5) is made of joined sections of piping stock or similar materials, and is engaged with the strut 50 extending downwardly for supporting an electrical battery 80 or other items on a shelf 72. A toroidal shaped, inflated, flotation structure 90 is engaged with the strut 50 for floating the apparatus on a body of water (not shown). The frame 70 is medially positioned on the strut 50 for being received within a central aperture 92 (the central hole) of the flotation structure 90. A bottom cover 94 of a water proof material is mounted integrally with the flotation structure 90 and positioned so as to close the central aperture 92 at a lower surface 96 of the flotation structure 90.

Figure 5:
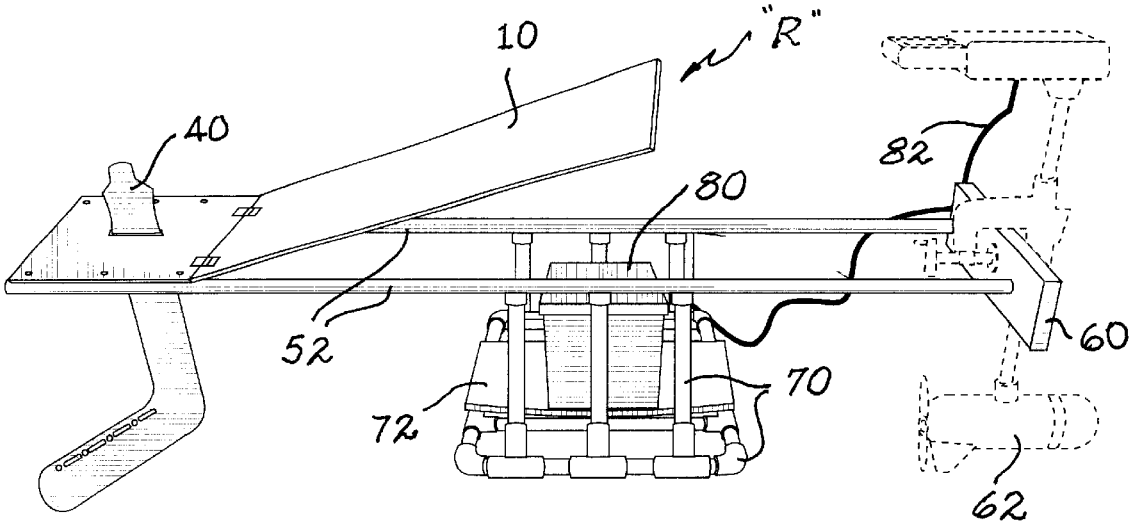
FIG. 5 is a right side elevational view thereof, without a seat and inflatable elements of the invention and showing further details of construction.

The rigid platform 10 is hinged, as best seen in FIG. 5, for moving between a lowered position "L" in resting contact with the strut 50 (FIG. 1), and a raised position "R" (FIG. 5) enabling access to the frame 70 and the electrical battery 80. An electrical cord 82 joins the battery 80 with the propulsion unit 62.

As best seen in FIG. 5, the strut 50 preferably includes a pair of rigid linear members 52 such as metal bars or tubes, positioned in parallel spaced apart juxtaposition for supporting the platform 10 which rests on them.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. Watercraft apparatus comprising: a rigid platform supporting a seat on an upper surface thereof; a rudder engaged at a rearward end of the platform and extending downwardly for providing stability to the apparatus; a strut extending forward of the platform and supporting a propulsion unit mounting means; a frame engaged with the strut and extending downwardly therefrom and supporting an electrical battery; and a toroidal flotation structure engaged with the strut for floating the apparatus on a body of water, the frame received within a central aperture of the flotation structure, a bottom cover integral with the flotation means and positioned so as to close the center aperture at a lower surface of the flotation structure; the rigid platform being hinged for moving between a lowered position in resting contact with the strut, and a raised position for gaining access to the electrical battery.

2. The apparatus of claim 1 wherein the strut includes a pair of rigid linear members positioned in parallel spaced apart juxtaposition.

* * * * *